US008119561B2

(12) United States Patent
Haraguchi et al.

(10) Patent No.: US 8,119,561 B2
(45) Date of Patent: Feb. 21, 2012

(54) HEAT-SENSITIVE TRANSFER IMAGE-RECEIVING SHEET AND PRODUCTION METHOD THEREOF

(75) Inventors: Nobuyuki Haraguchi, Ashigarakami-gun (JP); Kiyoshi Irita, Ashigarakami-gun (JP)

(73) Assignee: Fujifilm Corporation, Tokyo (JP)

( * ) Notice: Subject to any disclaimer, the term of this patent is extended or adjusted under 35 U.S.C. 154(b) by 1000 days.

(21) Appl. No.: 12/057,121

(22) Filed: Mar. 27, 2008

(65) Prior Publication Data

US 2008/0254241 A1 Oct. 16, 2008

(30) Foreign Application Priority Data

Mar. 28, 2007 (JP) ..... 2007-085504

(51) Int. Cl.
*B41M 5/035* (2006.01)
*B41M 5/50* (2006.01)

(52) U.S. Cl. ..... 503/227; 427/152

(58) Field of Classification Search ..... None
See application file for complete search history.

(56) References Cited

U.S. PATENT DOCUMENTS

| | | | | |
|---|---|---|---|---|
| 5,071,823 | A | 12/1991 | Matsushita et al. | |
| 7,795,177 | B2 * | 9/2010 | Onishi et al. | 503/227 |
| 2004/0058814 | A1 | 3/2004 | Yoshinari et al. | |

FOREIGN PATENT DOCUMENTS

| | | | |
|---|---|---|---|
| EP | 1529651 | A | 5/2005 |
| EP | 1655144 | A1 | 5/2006 |
| JP | 6-79974 | A | 3/1994 |
| JP | 8-156398 | A | 6/1996 |
| JP | 10-24666 | A | 1/1998 |
| JP | 3182829 | B2 | 4/2001 |
| JP | 2005-335115 | A | 12/2005 |
| JP | 2006-68918 | A | 3/2006 |
| JP | 2006-88691 | A | 4/2006 |
| JP | 2006-130810 | A | 5/2006 |
| JP | 2006130810 | A | 5/2006 |
| JP | 2007-55254 | A | 3/2007 |
| WO | 2007013649 | A | 2/2007 |

OTHER PUBLICATIONS

Japanese Office Action issued Apr. 5, 2011 for corresponding Japanese Patent Application No. JP 2007-085504.

* cited by examiner

*Primary Examiner* — Bruce H Hess
(74) *Attorney, Agent, or Firm* — Sughrue Mion, PLLC

(57) ABSTRACT

A heat-sensitive transfer image-receiving sheet containing at least one heat insulation layer and at least one receptor layer on a support, wherein said heat insulation layer contains at least one kind of hollow polymer particles and said receptor layer contains at least one latex polymer and at least one water-soluble polymer; wherein said water-soluble polymer is at least one of a gelatin and a polyvinyl alcohol in which the gelatin has an average molecular mass of 20,000 or more and the polyvinyl alcohol has a saponification degree of 95% or more and an average polymerization degree of from 200 to 1600 or has a saponification degree of less than 95% and an average polymerization degree of from 500 to 2000.

2 Claims, No Drawings

HEAT-SENSITIVE TRANSFER IMAGE-RECEIVING SHEET AND PRODUCTION METHOD THEREOF

FIELD OF THE INVENTION

The present invention relates to a heat-sensitive transfer image-receiving sheet and a production method of the same. In more detail, the present invention relates to a heat-sensitive transfer image-receiving sheet that is reduced in production troubles and image troubles, thereby achieving improvement in both print image quality and image density, and the present invention relates to a production method of the same.

BACKGROUND OF THE INVENTION

Various heat transfer recording methods have been known so far. Among these methods, dye diffusion transfer recording systems attract attention as a process that can produce a color hard copy having an image quality closest to that of silver halide photography (see, for example, "Joho Kiroku (Hard Copy) to Sono Zairyo no Shintenkai (Information Recording (Hard Copy) and New Development of Recording Materials)" published by Toray Research Center Inc., 1993, pp. 241-285; "Printer Zairyo no Kaihatsu (Development of Printer Materials)" published by CMC Publishing Co., Ltd., 1995, p. 180); "Coating—Hard-Gijutsu no Kako Genzai kara Mirai wo Manabu—(Coating—Learn the Future from the Past and Present Hardware Techniques—)" edited by Converting Technical Institute, 2002.

In this dye diffusion transfer recording system, a heat-sensitive transfer sheet (hereinafter also referred to as an ink sheet) containing dyes is superposed on a heat-sensitive transfer image-receiving sheet (hereinafter also referred to as an image-receiving sheet), and then the ink sheet is heated by a thermal head whose exothermic action is controlled by electric signals, in order to transfer the dyes contained in the ink sheet to the image-receiving sheet, thereby recording an image information. Three colors: cyan, magenta, and yellow, are used for recording a color image by overlapping one color to other, thereby enabling transferring and recording a color image having continuous gradation for color densities. Therefore, the thus-obtained image is excellent in middle tone reproduction and gradation representation, and thereby an extremely high-definition image can be obtained.

Further, such the dye diffusion transfer recording system has such merits that image formation can be performed in a dry state, an image can be visualized directly from digital data, and copying is simple, and therefore said recording system is widening its market as a full color hard copy system.

SUMMARY OF THE INVENTION

The present invention relates to a heat-sensitive transfer image-receiving sheet comprising at least one heat insulation layer and at least one receptor layer on a support, wherein said heat insulation layer comprises at least one kind of hollow polymer particles and said receptor layer comprises at least one latex polymer and at least one water-soluble polymer; wherein said water-soluble polymer is at least one of a gelatin and a polyvinyl alcohol in which the gelatin has an average molecular mass of 20,000 or more and the polyvinyl alcohol has a saponification degree of 95% or more and an average polymerization degree of from 200 to 1600 or has a saponification degree of less than 95% and an average polymerization degree of from 500 to 2000.

Other and further features and advantages of the invention will appear more fully from the following description.

DETAILED DESCRIPTION OF THE INVENTION

In the dye diffusion transfer recording system, because of the nature of the system in which an ink sheet and an image-receiving sheet are superposed to transfer a dye, the system requires that each of the ink sheet and the image-receiving sheet be excellent in smoothness, and also the ink sheet and the image-receiving sheet closely contact with each other when they are pressure-contacted with a thermal head. In order to satisfy such the requirement, cushion properties of the image-receiving sheet become important in addition to the smoothness. A lack of both smoothness and cushion properties forms spots where there is no contact between the ink sheet and the image-receiving sheet and thereby a failure of dye transfer is caused.

From the past, in order to give smoothness to the image-receiving sheet, there is sometimes used a composite support composed of a biaxially oriented polyolefin film containing micro voids (for example, JP-A-2006-68918 ("JP-A" means unexamined published Japanese patent application) and JP-A-2006-130810). It is known to produce a receptor layer by a method in which a solution of a receptor polymer dissolved in an organic solvent is coated on the composite support.

The inventors have investigated a method of producing an image-receiving sheet by applying a water-based coating liquid from environmental considerations such as reduction in an amount of an organic solvent discharged to environment and reduction in adverse affection to a human body caused by the organic solvent at the time of production.

In the case where the image-receiving sheet is formed by applying a water-based coating liquid, an aqueous latex is used as a polymer in its receptor layer or heat insulation layer. In this case, a water-soluble binder is actually added to a coating liquid to give these layers a protective colloidal property, thereby to prevent skinning of the coating liquid and also to improve deterioration of the coated surface state caused by aggregation of the latex. For example, in the afore-mentioned JP-A-2006-68918 and JP-A-2006-130810, there is described that a hydrophilic binder is added to both the receptor layer and the heat insulation layer and that gelatin and polyvinyl alcohol are used as a the hydrophilic binder. Further, in these literatures, there are described a method of using as the gelatin an alkali-treated gelatin or acid-treated gelatin and a method of using as the polyvinyl alcohol a polyvinyl alcohol having an average polymerization degree of 3500 or a polyvinyl alcohol having a saponification degree of from 87% to 89% and an average polymerization degree of 300. A certain degree of improvement was attained by these methods, but satisfactory effects were not obtained. Further, in Japanese Patent No. 3182829, there are described a method of disposing an intermediate layer between a receptor layer and a support, in which the intermediate layer contains a polyvinyl alcohol having a polymerization degree of 100 and a saponification degree of not more than 98%, a polyvinyl alcohol having a polymerization degree of 200 or 300 and a saponification degree of from 50% to 70%, and a polyvinyl alcohol resin having a polymerization degree of 400 and a saponification degree of 95% or less, in order to enhance adhesiveness to ink ribbon and to improve a print quality. Even though some improvement effects were recognized according to this method, the degree of effects was not satisfactory. Therefore, development of further improved method has been desired.

The present invention provides the following means:

(1) A heat-sensitive transfer image-receiving sheet comprising at least one heat insulation layer and at least one receptor layer on a support, wherein said heat insulation layer comprises at least one kind of hollow polymer particles and said receptor layer comprises at least one latex polymer and at least one water-soluble polymer; wherein said water-soluble polymer is at least one of a gelatin and a polyvinyl alcohol in which the gelatin has an average molecular mass of 20,000 or more and the polyvinyl alcohol has a saponification degree of 95% or more and an average polymerization degree of from 200 to 1600 or has a saponification degree of less than 95% and an average polymerization degree of from 500 to 2000.

(2) The method of producing a heat-sensitive transfer image-receiving sheet as described in item (1), wherein said heat-sensitive transfer image-receiving sheet is produced according to a simultaneous multilayer-coating method using an aqueous coating solution.

The present invention will be explained in detail below.

The heat-sensitive (thermal) transfer image-receiving sheet used in the present invention is provided with at least one receptor layer (dye-receiving layer) on a support, and at least one heat insulation layer (porous layer) between the support and the receptor layer. Moreover, an intermediate layer such as a white-background-control layer, a charge-control layer (an electrification-control layer), an adhesive layer, a primer layer, and an undercoat layer, may be provided between the support and the receptor layer.

In the present invention, at least one receptor layer and at least one heat insulation layer are coated according to a water-based coating method. (Herein, the "water-based coating method" means a method that forms a coating by applying a water-based or aqueous coating liquid.) These layers are preferably formed by a simultaneous multilayer coating. When an intermediate layer is provided, the receptor layer, the heat insulation layer and the intermediate layer may be formed by the simultaneous multilayer coating.

It is preferable that a curling control layer, a writing layer, or a charge-control layer be formed on the backside of the support. Each of these layers may be applied using a usual method such as a roll coating, a bar coating, a gravure coating, and a gravure reverse coating.

<Water-Soluble Polymer>

In the following the water-soluble polymer will be explained.

It is preferred that each of image-receiving-sheet-constituting layers such as a receptor layer and a heat insulation layer contain a water-soluble polymer. Herein, the "water-soluble polymer" means a polymer which dissolves, in 100 g water at 20° C., in an amount of preferably 0.05 g or more, more preferably 0.1 g or more, further preferably 0.5 g or more, and particularly preferably 1 g or more. The water-soluble polymer that can be used in the present invention is a polyvinyl alcohol and a gelatin. The latex polymers, which will be explained later, are not included in the water-soluble polymers which can be used in the present invention. In the present invention, the water-soluble polymer is also referred to as a binder, for differentiation from the latex polymer described above. The amount of the water-soluble polymer is preferably from 1 to 25% by mass, more preferably from 1 to 10% by mass, based on the entire mass of the layer.

(Polyvinyl Alcohol)

The polyvinyl alcohol that can be used in the present invention is explained in more detail. As the polyvinyl alcohol that can be used in the present invention, it is preferred that the polyvinyl alcohol have a saponification degree of 95% or more and an average polymerization degree of from 200 to 1600, or the polyvinyl alcohol have a saponification degree of less than 95% and an average polymerization degree of from 500 to 2000. Specific examples of the polyvinyl alcohol are described below.

Examples of completely saponificated polyvinyl alcohol include PVA-105 [polyvinyl alcohol (PVA) content: 94.0 mass % or more; degree of saponification: 98.5±0.5 mol %; content of sodium acetate: 1.5 mass % or less; volatile constituent: 5.0 mass % or less; viscosity (4 mass %; 20° C.): 5.6±0.4 CPS]; PVA-110 [PVA content: 94.0 mass %; degree of saponification: 98.5±0.5 mol %; content of sodium acetate: 1.5 mass %; volatile constituent: 5.0 mass %; viscosity (4 mass %; 20° C.): 11.0±0.8 CPS]; PVA-CST [PVA content: 94.0 mass %; degree of saponification: 96.0±0.5 mol %; content of sodium acetate: 1.0 mass %; volatile constituent: 5.0 mass %; viscosity (4 mass %; 20° C.): 27.0±3.0 CPS]; and PVA-HC [PVA content: 90.0 mass %; degree of saponification: 99.85 mol % or more; content of sodium acetate: 2.5 mass %; volatile constituent: 8.5 mass %; viscosity (4 mass %; 20° C.): 25.0±3.5 CPS] (all trade names, manufactured by Kuraray Co., Ltd.), and the like.

Examples of partially saponificated polyvinyl alcohol include PVA-205 [PVA content: 94.0 mass %; degree of saponification: 88.0±1.5 mol %; content of sodium acetate: 1.0 mass %; volatile constituent: 5.0 mass %; viscosity (4 mass %; 20° C.): 5.0±0.4 CPS]; PVA-210 [PVA content: 94.0 mass %; degree of saponification: 88.0±1.0 mol %; content of sodium acetate: 1.0 mass %; volatile constituent: 5.0 mass %; viscosity (4 mass %; 20° C.): 9.0±1.0 CPS]; PVA-217 [PVA content: 94.0 mass %; degree of saponification: 88.0±1.0 mol %; content of sodium acetate: 1.0 mass %; volatile constituent: 5.0 mass %; viscosity (4 mass %; 20° C.): 22.5±2.0 CPS]; PVA-220 [PVA content: 94.0 mass %; degree of saponification: 88.0±1.0 mol %; content of sodium acetate: 1.0 mass %; volatile constituent: 5.0 mass %; viscosity (4 mass %; 20° C.): 30.0±3.0 CPS]; PVA-217EE [PVA content: 94.0 mass %; degree of saponification: 88.0±1.0 mol %; content of sodium acetate: 1.0 mass %; volatile constituent: 5.0 mass %; viscosity (4 mass %; 20° C.): 23.0±3.0 CPS]; PVA-217E [PVA content: 94.0 mass %; degree of saponification: 88.0±1.0 mol %; content of sodium acetate: 1.0 mass %; volatile constituent: 5.0 mass %; viscosity (4 mass %; 20° C.): 23.0±3.0 CPS]; PVA-220E [PVA content: 94.0 mass %; degree of saponification: 88.0±1.0 mol %; content of sodium acetate: 1.0 mass %; volatile constituent: 5.0 mass %; viscosity (4 mass %; 20° C.): 31.0±4.0 CPS]; PVA-224E [PVA content: 94.0 mass %; degree of saponification: 88.0±1.0 mol %; content of sodium acetate: 1.0 mass %; volatile constituent: 5.0 mass %; viscosity (4 mass %; 20° C.): 45.0±5.0 CPS]; PVA-405 [PVA content: 94.0 mass %; degree of saponification: 81.5±1.5 mol %; content of sodium acetate: 1.0 mass %; volatile constituent: 5.0 mass %; viscosity (4 mass %; 20° C.): 4.8±0.4 CPS]; PVA-420 [PVA content: 94.0 mass %; degree of saponification: 79.5±1.5 mol %; content of sodium acetate: 1.0 mass %; volatile constituent: 5.0 mass %]; PVA-613 [PVA content: 94.0 mass %; degree of saponification: 93.5±1.0 mol %; content of sodium acetate: 1.0 mass %; volatile constituent: 5.0 mass %; viscosity (4 mass %; 20° C.): 16.5±2.0 CPS]; L-8 [PVA content: 96.0 mass %; degree of saponification: 71.0±1.5 mol %; content of sodium acetate: 1.0 mass % (ash); volatile constituent: 3.0 mass %; viscosity (4 mass %; 20° C.): 5.4±0.4 CPS] (all trade names, manufactured by Kuraray Co., Ltd.), and the like.

The above values were measured in the manner according to JIS K-6726-1977.

With respect to modified polyvinyl alcohols, those described in Koichi Nagano et al., "Poval", Kobunshi Kankokai, Inc. are useful. The modified polyvinyl alcohols include polyvinyl alcohols modified by cations, anions, —SH compounds, alkylthio compounds, or silanols.

Examples of such modified polyvinyl alcohols (modified PVA) include C polymers, such as C-118, C-318, and C-318-2A (all being trade names of Kuraray Co., Ltd.); K polymers, such as KL-318, KL-506, and KM-618 (all being trade names of Kuraray Co., Ltd.); M polymers, such as M-115 (a trade name of Kuraray co., Ltd.); MP polymers, such as MP-102, and MP-103 (all being trade names of Kuraray Co., Ltd.); and R polymers, such as R-2105 (a trade name of Kuraray Co., Ltd.).

(Gelatin)

In the present invention, gelatin can be used as a hydrophilic binder. However, it is possible to use not only gelatin in a narrow sense, but also other gelatin compounds in a broad sense such as gelatin derivatives and graft polymers of gelatin with other polymers. As the gelatin, there can be used not only a lime-treated gelatin, but also an acid-treated gelatin and an enzyme-treated gelatin as described in Bull. Soc. Sci. Photo. Japan, No. 16, P30 (1966). Further, it is possible to use hydrolysates and enzyme resolvents.

The molecular mass of gelatin that can be used in the present invention is preferably 20,000 or more. If the molecular mass is too low, a protective colloid property is too low to obtain desirable effects.

The molecular mass of gelatin can be measured according to the PAGI method (a test method of gelatin for photographic use) using HPLC (see the home page of Shodex Company for the particulars).

Next, the heat insulation layer and the receptor layer will be explained in detail below.

(Heat Insulation Layer)

The heat insulation layer serves to protect the support from heat when a thermal head or the like is used to carry out a transfer operation under heating. Also, because the heat insulation layer generally has proper cushion characteristics, a heat-sensitive transfer image-receiving sheet having high printing sensitivity can be obtained even in the case of using paper as a support. The heat insulation layer may be a single layer, or multi-layers. The heat insulation layer is generally arranged at a nearer location to the support than the receptor layer.

In the image-receiving sheet of the present invention, the heat insulation layer is preferably formed by a water-based coating method. Further, the heat insulation layer preferably contains a hollow polymer and the above-described water-soluble binder.

The hollow polymer particles in the present invention are polymer particles having independent pores inside of the particles, and preferably they are latex polymer particles. Examples of the hollow polymer particles include (1) non-foaming type hollow particles obtained in the following manner: water is contained inside of a capsule wall formed of a polystyrene, acryl resin, or styrene/acryl resin, and, after a coating solution is applied and dried, the water in the particles is vaporized out of the particles, with the result that the inside of each particle forms a hollow; (2) foaming type microballoons obtained in the following manner: a low-boiling point liquid, such as butane and pentane, is encapsulated in a resin constituted of any one of polyvinylidene chloride, polyacrylonitrile, polyacrylic acid, and polyacrylate, or their mixture or polymer, and after the resin coating material is applied, it is heated to expand the low-boiling point liquid inside of the particles, whereby the inside of each particle is made to be hollow; and (3) microballoons obtained by foaming the above (2) under heating in advance, to make hollow polymer particles.

The particle size of the hollow polymer particles is preferably 0.1 to 5 μm, more preferably 0.2 to 3 μm, further preferably 0.3 to 1 μm. If the size is too small, a hollow rate tends to reduce, so that it becomes difficult to obtain a desired heat insulating property. On the other hand, if the size is too large, occurrence of the coated surface state troubles owing to components other than coarse particles in the heat insulation layer becomes frequent.

The hollow ratio (percentage of hollowness) of the hollow polymer particles is preferably in the range of from about 20% to about 70%, and more preferably from 20% to 50%. If the hollow rate is too small, it becomes difficult to obtain a desired heat insulating property. On the other hand, if the hollow rate is too large, a rate of both brittle hollow polymer particles and incomplete hollow particles increases. As a result, such problems arise that a print failure occurs and also satisfactory film strength can not be obtained.

If necessary, the hollow polymer may be used as a mixture of two or more kinds of the polymers. Specific examples of the above (1) include Rohpake 1055 manufactured by Rohm and Haas Co.; Boncoat PP-1000 manufactured by Dainippon Ink and Chemicals, Incorporated; SX866(B) manufactured by JSR Corporation; and Nippol MH5055 manufactured by Nippon Zeon (all of these product names are trade names). Specific examples of the above (2) include F-30 and F-50 manufactured by Matsumoto Yushi-Seiyaku Co., Ltd. (all of these product names are trade names). Specific examples of the above (3) include F-30E manufactured by Matsumoto Yushi-Seiyaku Co., Ltd, and Expancel 461 DE, 551DE and 551DE20 manufactured by Nippon Ferrite (all of these product names are trade names). The hollow polymer that is used in the heat insulation layer may be used in the form of a latex.

Thought there is no particular restriction, the glass transition temperature (Tg) of the hollow polymer particles is preferably 70° C. or more and more preferably 100° C. or more. These hollow polymer particles may be used in combinations of two or more of those, according to the need.

The solid content of the hollow polymer particles in the heat insulation layer preferably falls in a range from 5 to 2,000 parts by mass, assuming that the solid content of the binder resin be 100 parts by mass. Also, the ratio by mass of the solid content of the hollow polymer particles in the coating solution is preferably 1 to 70% by mass and more preferably 10 to 40% by mass. If the percentage of the hollow polymer is too low, it is difficult to obtain a satisfactory heat insulating property. On the other hand, if the percentage of the hollow polymer is too high, bonding capacities among hollow polymers decrease. As a result, reduction of the bonding capacity causes problems such as falling-off of powder and film peeling during processing.

The amount of the binder in the coating solution for the heat insulation layer is preferably 0.5 to 14% by mass, and particularly preferably 1 to 6% by mass. Also, the coating amount of the above hollow polymer particles in the heat insulation layer is preferably 1 to 100 g/m$^2$, and more preferably 5 to 20 g/m$^2$.

The thickness of the heat insulation layer containing the hollow polymer particles is preferably from 5 to 50 μm, more preferably from 5 to 40 μm.

(Receptor Layer)

The receptor layer performs functions of receiving dyes transferred from an ink sheet and retaining an image formed. The image-receiving sheet of the present invention has at least one receptor layer preferably containing at least one thermoplastic receiving polymer that can receive a dye.

The receptor polymer is preferably used in the form of latex polymer in which the polymer is dispersed in an aqueous dispersion medium. Further, the receptor layer preferably contains a water soluble polymer in addition to the latex polymer. Incorporation of both the latex polymer and the water soluble polymer enables to arrange the water soluble polymer that is hardly colored with a dye among the latex polymer, so that diffusion of the dye with which the latex polymer has been colored can be prevented. Consequently, a fluctuation in sharpness of the receptor layer with the lapse of time can be reduced, and it is possible to form a recorded image with a little change of a transfer image with the lapse of time.

In the receptor layer, the latex polymer that is used as a receptor polymer can be used together with another functional latex polymer, for the purposes of regulation of elastic coefficient of the film or the like.

Further, to the receptor layer, there may be added an ultraviolet absorbent, a releasing agent, a sliding agent, an antioxidant, an antiseptic, a surfactant, and other additives.

<Latex Polymer>

The latex polymer (polymer latex) that can be used in the present invention is explained.

In the heat-sensitive transfer image-receiving sheet of the present invention, the latex polymer that can be used in the receptor layer is a dispersion in which a water-insoluble hydrophobic polymer is dispersed as fine particles in a water-soluble dispersion medium. The dispersed state may be one in which polymer is emulsified in a dispersion medium, one in which polymer underwent emulsion polymerization, one in which polymer underwent micelle dispersion, one in which polymer molecules partially have a hydrophilic structure and thus the molecular chains themselves are dispersed in a molecular state, or the like. Latex polymers are described in "Gosei Jushi Emulsion (Synthetic Resin Emulsion)", compiled by Taira Okuda and Hiroshi Inagaki, issued by Kobunshi Kanko Kai (1978); "Gosei Latex no Oyo (Application of Synthetic Latex)", compiled by Takaaki Sugimura, Yasuo Kataoka, Souichi Suzuki, and Keishi Kasahara, issued by Kobunshi Kanko Kai (1993); Soichi Muroi, "Gosei Latex no Kagaku (Chemistry of Synthetic Latex)", issued by Kobunshi Kanko Kai (1970); Yoshiaki Miyosawa (supervisor) "Suisei Coating-Zairyo no Kaihatsu to Oyo (Development and Application of Aqueous Coating Material)", issued by CMC Publishing Co., Ltd. (2004) and JP-A-64-538, and so forth. In the present invention, the average diameter of the dispersed particles is preferably in the range of approximately 1 to 50,000 nm, more preferably 5 to 1,000 nm.

There is no particular limitation to the size (i.e. particle diameter) distribution of dispersing particles. So, they may have a broad size distribution, or a mono-dispersive size distribution.

The latex polymer for use in the present invention may be latex of the so-called core/shell type, other than ordinary latex polymer of a uniform structure. When using a core/shell type latex polymer, it is preferred in some cases that the core and the shell have different glass transition temperatures. The glass transition temperature (Tg) of the latex polymer for use in the present invention is preferably −30° C. to 130° C., more preferably 0° C. to 120° C. Especially, the glass transition temperature (Tg) is preferably 40° C. or more (preferably from 40° C. to 120° C.), more preferably 70° C. or more (from 70° C. to 100° C.).

As the latex polymer for use in the present invention, acrylic-series polymers, polyesters, rubbers (e.g., SBR resins), polyurethanes, polyvinyl chlorides, polyvinyl acetates, polyvinylidene chlorides, and polyolefins, are preferably used. These polymers may be straight-chain, branched, or cross-linked polymers, the so-called homopolymers obtained by polymerizing single type of monomers, or copolymers obtained by polymerizing two or more types of monomers. In the case of the copolymers, these copolymers may be either random copolymers or block copolymers. The molecular mass of each of these polymers is preferably 5,000 to 1,000,000, and further preferably 10,000 to 500,000 in terms of number average molecular mass. A polymer having an excessively small molecular mass imparts insufficient dynamic strength to a layer containing a latex of the polymer, and a polymer having an excessively large molecular mass brings about poor film-forming ability. Crosslinkable latex polymers are also preferably used.

No particular limitation is imposed on a monomer to be used in synthesizing the latex polymer in the present invention, and the following monomer groups (a) to (j) may be preferably used as those polymerizable in a usual radical polymerization or ion polymerization method. These monomers may be selected singly or combined freely to synthesize the latex polymer.

Monomer Groups (a) to (j)

(a) Conjugated dienes: 1,3-pentadiene, isoprene, 1-phenyl-1,3-butadiene, 1-α-naphthyl-1,3-butadiene, 1-β-naphthyl-1,3-butadiene, cyclopentadiene, etc.

(b) Olefins: ethylene, propylene, vinyl chloride, vinylidene chloride, 6-hydroxy-1-hexene, 4-pentenoic acid, methyl 8-nonenate, vinylsulfonic acid, trimethylvinylsilane, trimethoxyvinylsilane, 1,4-divinylcyclohexane, 1,2,5-trivinylcyclohexane, etc.

(c) α,β-unsaturated carboxylates: alkyl acrylates, such as methyl acrylate, ethyl acrylate, butyl acrylate, cyclohexyl acrylate, 2-ethylhexyl acrylate, and dodecyl acrylate; substituted alkyl acrylates, such as 2-chloroethyl acrylate, benzyl acrylate, and 2-cyanoethyl acrylate; alkyl methacrylates, such as methyl methacrylate, butyl methacrylate, 2-ethylhexyl methacrylate, and dodecyl methacrylate; substituted alkyl methacrylates, such as 2-hydroxyethyl methacrylate, glycidyl methacrylate, glycerin monomethacrylate, 2-acetoxyethyl methacrylate, tetrahydrofurfuryl methacrylate, 2-methoxyethyl methacrylate, polypropylene glycol monomethacrylates (mole number of added polyoxypropylene=2 to 100), 3-N,N-dimethylaminopropyl methacrylate, chloro-3-N,N,N-trimethylammoniopropyl methacrylate, 2-carboxyethyl methacrylate, 3-sulfopropyl methacrylate, 4-oxysulfobutyl methacrylate, 3-trimethoxysilylpropyl methacrylate, allyl methacrylate, and 2-isocyanatoethyl methacrylate; derivatives of unsaturated dicarboxylic acids, such as monobutyl maleate, dimethyl maleate, monomethyl itaconate, and dibutyl itaconate; multifunctional esters, such as ethylene glycol diacrylate, ethylene glycol dimethacrylate, 1,4-cyclohexane diacrylate, pentaerythritol tetramethacrylate, pentaerythritol triacrylate, trimethylolpropane triacrylate, trimethylolethane triacrylate, dipentaerythritol pentamethacrylate, pentaerythritol hexaacrylate, and 1,2,4-cyclohexane tetramethacrylate; etc.)

(d) α,β-unsaturated carboxylic acid amides: acrylamide, methacrylamide, N-methylacrylamide, N,N-dimethylacrylamide, N-methyl-N-hydroxyethylmethacrylamide, N-tert-butylacrylamide, N-tert-octylmethacrylamide, N-cyclohexylacrylamide, N-phenylacrylamide, N-(2-acetoacetoxyethyl) acrylamide, N-acryloylmorpholine, diacetone acrylamide, itaconic diamide, N-methylmaleimide, 2-acrylamide-methylpropane sulfonic acid, methylenebisacrylamide, dimethacryloylpiperazine, etc.

(e) Unsaturated nitriles: acrylonitrile, methacrylonitrile, etc.
(f) Styrene and derivatives thereof: styrene, vinyltoluene, p-tert-butylstyrene, vinylbenzoic acid, methyl vinylbenzoate, α-methylstyrene, p-chloromethylstyrene, vinylnaphthalene, p-hydroxymethylstyrene, sodium p-styrenesulfonate, potassium p-styrenesulfinate, p-aminomethylstyrene, 1,4-divinylbenzene, etc.
(g) Vinyl ethers: methyl vinyl ether, butyl vinyl ether, methoxyethyl vinyl ether, etc.
(h) Vinyl esters: vinyl acetate, vinyl propionate, vinyl benzoate, vinyl salicylate, vinyl chloroacetate, etc.
(i) α,β-unsaturated carboxylic acids and salts thereof: acrylic acid, methacrylic acid, itaconic acid, maleic acid, sodium acrylate, ammonium methacrylate, potassium itaconate, etc.
(j) Other polymerizable monomers: N-vinylimidazole, 4-vinylpyridine, N-vinylpyrrolidone, 2-vinyloxazoline, 2-isopropenyloxazoline, divinylsulfone, etc.

Latex polymers that can be used in the present invention are also commercially available, and polymers described below may be utilized. Examples of the acrylic-series polymers include Cevian A-4635, 4718, and 4601 (trade names, manufactured by Daicel Chemical Industries); Nipol Lx811, 814, 821, 820, 855 (P-17: Tg 36° C.), and 857×2 (P-18: Tg 43° C.) (trade names, manufactured by Nippon Zeon Co., Ltd.); Voncoat R3370 (P-19: Tg 25° C.), and 4280 (P-20: Tg 15° C.) (trade names, manufactured by Dai-Nippon Ink & Chemicals, Inc.); Julimer ET-410 (P-21: Tg 44° C.) (trade name, manufactured by Nihon Junyaku K.K.); AE116 (P-22: Tg 50° C.), AE119 (P-23: Tg 55° C.), AE121 (P-24: Tg 58° C.), AE125 (P-25: Tg 60GC), AE134 (P-26: Tg 48° C.), AE137 (P-27: Tg 48° C.), AE140 (P-28: Tg 53° C.), and AE173 (P-29: Tg 60° C.) (trade names, manufactured by JSR Corporation); Aron A-104 (P-30: Tg 45° C.) (trade name, manufactured by Toagosei Co., Ltd.); NS-600X, and NS-620X (trade names, manufactured by Takamatsu Yushi K.K.); VINYBLAN 2580, 2583, 2641, 2770, 2770H, 2635, 2886, 5202C, and 2706 (trade names, manufactured by Nissin Chemical Industry Co., Ltd.).

Examples of the polyesters include FINETEX ES650, 611, 675, and 850 (trade names, manufactured by Dainippon Ink and Chemicals, Incorporated); WD-size, and WMS (trade names, manufactured by Eastman Chemical Ltd.); A-110, A-115GE, A-120, A-121, A-124GP, A-124S, A-160P, A-210, A-215GE, A-510, A-513E, A-515GE, A-520, A-610, A-613, A-615GE, A-620, WAC-10, WAC-15, WAC-17XC, WAC-20, S-110, S-110EA, S-111SL, S-120, S-140, S-140A, S-250, S-252G; S-250S, S-320, S-680, DNS-63P, NS-122L, NS-122LX, NS-244LX, NS-140L, NS-141 LX, and NS-282LX (trade names, manufactured by Takamatsu Yushi K.K.); Aronmelt PES-1000 series, and PES-2000 series (trade names, manufactured by Toagosei Co., Ltd.); Bironal MD-1100, MD-1200, MD-1220, MD-1245, MD-1250, MD-1335, MD-1400, MD-1480, MD-1500, MD-1930, and MD-1985 (trade names, manufactured by Toyobo Co., Ltd.); and Ceporjon ES (trade name, manufactured by Sumitomo Seika Chemicals Co., Ltd.).

Examples of the polyurethanes include HYDRAN AP10, AP20, AP30, AP40, and 101H, Vondic 1320NS and 1610NS (trade names, manufactured by Dainippon Ink and Chemicals, Incorporated); D-1000, D-2000, D-6000, D-4000, and D-9000 (trade names, manufactured by Dainichi Seika Color & Chemicals Mfg. Co., Ltd.); NS-155X, NS-310A, NS-30X, and NS-311X (trade names, manufactured by Takamatsu Yushi K.K.); Elastron (trade name, manufactured by Dai-ichi Kogyo Seiyaku Co., Ltd.).

Examples of the rubbers include LACSTAR 7310K, 3307B, 4700H, and 7132C (trade names, manufactured by Dainippon Ink & Chemicals Incorporated); Nipol Lx416, LX410, LX430, LX435, LX110, LX415A, LX438C, 2507H, LX303A, LX407BP series, V1004, and MH5055 (trade names, manufactured by Nippon Zeon Co., Ltd.).

Examples of poly vinyl chlorides include G351 and G576 (trade names, manufactured by Nippon Zeon Co., Ltd.); VINYBLAN 240, 270, 277, 375, 386, 609, 550, 601, 602, 630, 660, 671, 683, 680, 680S, 681N, 685R, 277, 380, 381, 410, 430, 432, 860, 863, 865, 867, 900, 900GT, 938 and 950 (trade names, manufactured by Nissin Chemical Industry Co., Ltd.). Examples of polyvinylidene chlorides include L502 and L513 (trade names, manufactured by Asahi Kasei Corporation); D-5071 (trade name, manufactured by Dai-Nippon Ink & Chemicals, Inc.). Examples of the polyolefins include Chemipearl S120, SA100, and V300 (P-40: Tg 80° C.) (trade names, manufactured by Mitsui Petrochemical); Voncoat 2830, 2210, and 2960 (trade names, manufactured by Dainippon Ink and Chemicals, Incorporated); Zaikusen and Ceporjon G (trade names, manufactured by Sumitomo Seika Chemicals Co., Ltd.). Examples of the copolymer nylons include Ceporjon PA (trade name, manufactured by Sumitomo Seika Chemicals Co., Ltd.).

Examples of the polyvinyl acetates include VINYBLAN 1080, 1082, 1085W, 1108W, 1108S, 1563M, 1566, 1570, 1588C, A22J7-F2, 1128C, 1137, 1138, A20J2, A23J1, A23J1, A23K1, A23P2E, A68J1N, 1086A, 1086, 1086D, 1108S, 1187, 1241LT, 1580N, 1083, 1571, 1572, 1581, 4465, 4466, 4468W, 4468S, 4470, 4485LL, 4495LL, 1023, 1042, 1060, 1060S, 1080M, 1084W, 1084S, 1096, 1570K, 1050, 1050S, 3290, 1017AD, 1002, 1006, 1008, 1107L, 1225, 1245L, GV-6170, GV-6181, 4468W, and 4468S (trade names, manufactured by Nisshin Chemical Industry Co., Ltd.).

These latex polymers may be used singly, or two or more of these polymers may be blended, if necessary.

In the present invention, at least one receptor layer is formed by coating a water-based coating liquid. In the case where a plurality of receptor layers is coated, it is more preferred that the receptor layers be formed by coating water-based coating liquids, followed by drying. The "water-based" or "aqueous" so-called herein means that 60% by mass or more of the solvent (dispersion medium) of the coating solution is water. As a component other than water in the coating solution, a water miscible organic solvent may be used, such as methyl alcohol, ethyl alcohol, isopropyl alcohol, methyl cellosolve, ethyl cellosolve, dimethylformamide, ethyl acetate, diacetone alcohol, furfuryl alcohol, benzyl alcohol, diethylene glycol monoethyl ether, and oxyethyl phenyl ether.

Preferable examples of the latex polymer for use in the present invention include polylactates, polyurethanes, polycarbonates, polyesters, polyacetals, and SBRs, and polyvinyl chlorides. Among these, polyesters, polycarbonates, and polyvinyl chlorides are preferable.

In the present invention, polyvinyl chlorides are preferred among the above-described latex polymer. Of these polyvinyl chlorides that are latex polymer containing at least a recurring unit obtained from vinyl chloride, preferred is a latex polymer containing a recurring unit obtained from vinyl chloride in an amount of 50 mole % or more based on the latex polymer, and more preferred is a copolymerized latex polymer. With respect to the copolymerized latex polymer, preferable monomers that polymerize with vinyl chloride are acrylic or methacrylic acid or esters thereof, vinyl acetate, and ethylene, more preferably acrylic or methacrylic acid or esters thereof, and still more preferably acrylic acid esters. The alcohol moiety that composes the ester group of the acrylic acid ester preferably has carbon atoms of from 1 to 10, and more preferably from 1 to 8.

As the polyvinyl chlorides, the above-described polymers may be used. Of the above-described polyvinyl chlorides, preferred are VINYBLAN 240, VINYBLAN 270, VINYBLAN 276, VINYBLAN 277, VINYBLAN 375, VINYBLAN 380, VINYBLAN 386, VINYBLAN 410, VINYBLAN 430, VINYBLAN 432, VINYBLAN 550, VINYBLAN 601, VINYBLAN 602, VINYBLAN 609, VINYBLAN 619, VINYBLAN 680, VINYBLAN 680S, VINYBLAN 681N, VINYBLAN 683, VINYBLAN 685R, VINYBLAN 690, VINYBLAN 860, VINYBLAN 863, VINYBLAN 685, VINYBLAN 867, VINYBLAN 900, VINYBLAN 938, VINYBLAN 950, each of which is a product of Nissin Chemical Industry Co., Ltd.; SE1320 and S-830, each of which is a product of Sumitomo Chemtech.

It is preferable to use a chelating agent in synthesizing the latex polymer to be used in the present invention. The chelating agent is a compound capable of coordinating (chelating) a polyvalent ion, such as metal ion (e.g., iron ion) or alkaline earth metal ion (e.g., calcium ion), and examples of the chelate compound which can be used include the compounds described in JP-B-6-8956 ("JP-B" means examined Japanese patent publication), U.S. Pat. No. 5,053,322, JP-A-4-73645, JP-A-4-127145, JP-A-4-247073, JP-A-4-305572, JP-A-6-11805, JP-A-5-173312, JP-A-5-66527, JP-A-5-158195, JP-A-6-118580, JP-A-6-110168, JP-A-6-161054, JP-A-6-175299, JP-A-6-214352, JP-A-7-114161, JP-A-7-114154, JP-A-7-120894, JP-A-7-199433, JP-A-7-306504, JP-A-9-43792, JP-A-8-314090, JP-A-10-182571, JP-A-10-182570, and JP-A-11-190892.

Preferred examples of the chelating agent include inorganic chelate compounds (e.g., sodium tripolyphosphate, sodium hexametaphosphate, sodium tetrapolyphosphate), aminopolycarboxylic acid-based chelate compounds (e.g., nitrilotriacetic acid, ethylenediaminetetraacetic acid), organic phosphonic acid-based chelate compounds (e.g., compounds described in Research Disclosure, No. 18170, JP-A-52-102726, JP-A-53-42730, JP-A-56-97347, JP-A-54-121127, JP-A-55-4024, JP-A-55-4025, JP-A-55-29883, JP-A-55-126241, JP-A-55-65955, JP-A-55-65956, JP-A-57-179843, JP-A-54-61125, and West German Patent No. 1045373), polyphenol-based chelating agents, and polyamine-based chelate compounds, with aminopolycarboxylic acid derivatives being particularly preferred.

Preferred examples of the aminopolycarboxylic acid derivative include the compounds shown in the Table attached to "EDTA (—Complexane no Kagaku—) (EDTA—Chemistry of Complexane—)", Nankodo (1977). In these compounds, a part of the carboxyl groups may be substituted by an alkali metal salt, such as sodium or potassium or by an ammonium salt. More preferred examples of the aminopolycarboxylic acid derivative include iminodiacetic acid, N-methyliminodiacetic acid, N-(2-aminoethyl)iminodiacetic acid, N-(carbamoylmethyl)iminodiacetic acid, nitrilotriacetic acid, ethylenediamine-N,N'-diacetic acid, ethylenediamine-N,N'-di-α-propionic acid, ethylenediamine-N,N'-di-β-propionic acid, N,N'-ethylene-bis(α-o-hydroxyphenyl)glycine, N,N'-di(2-hydroxybenzyl)ethylenediamine-N,N'-diacetic acid, ethylenediamine-N,N'-diacetic acid-N,N'-diacetohydroxamic acid, N-hydroxyethylethylenediamine-N,N',N'-triacetic acid, ethylenediamine-N,N,N',N'-tetraacetic acid, 1,2-propylenediamine-N,N,N',N'-tetraacetic acid, d,l-2,3-diaminobutane-N,N,N',N'-tetraacetic acid, meso-2,3-diaminobutane-N,N,N',N'-tetraacetic acid, 1-phenylethylenediamine-N,N,N',N'-tetraacetic acid, d,l-1,2-diphenylethylenediamine-N,N,N',N'-tetraacetic acid, 1,4-diaminobutane-N,N,N',N'-tetraacetic acid, trans-cyclobutane-1,2-diamine-N,N,N',N'-tetraacetic acid, trans-cyclopentane-1,2-diamine-N,N,N',N'-tetraacetic acid, trans-cyclohexane-1,2-diamine-N,N,N',N'-tetraacetic acid, cis-cyclohexane-1,2-diamine-N,N,N',N'-tetraacetic acid, cyclohexane-1,3-diamine-N,N,N',N'-tetraacetic acid, cyclohexane-1,4-diamine-N,N,N',N'-tetraacetic acid, o-phenylenediamine-N,N,N',N'-tetraacetic acid, cis-1,4-diaminobutene-N,N,N',N'-tetraacetic acid, trans-1,4-diaminobutene-N,N,N',N'-tetraacetic acid, α,α'-diamino-o-xylene-N,N,N',N'-tetraacetic acid, 2-hydroxy-1,3-propanediamine-N,N,N',N'-tetraacetic acid, 2,2'-oxy-bis(ethyliminodiacetic acid), 2,2'-ethylenedioxy-bis(ethyliminodiacetic acid), ethylenediamine-N,N'-diacetic acid-N,N'-di-α-propionic acid, ethylenediamine-N,N'-diacetic acid-N,N'-di-β-propionic acid, ethylenediamine-N,N,N',N'-tetrapropionic acid, diethylenetriamine-N,N,N',N",N"-pentaacetic acid, triethylenetetramine-N,N,N',N",N'",N'"-hexaacetic acid, and 1,2,3-triaminopropane-N,N,N',N",N'",N'"-hexaacetic acid. In these compounds, a part of the carboxyl groups may be substituted by an alkali metal salt, such as sodium or potassium or by an ammonium salt.

The amount of the chelating agent to be added is preferably 0.01 mass % to 0.4 mass %, more preferably 0.02 mass % to 0.3 mass %, and especially preferably 0.03 mass % to 0.15 mass %, based on the total amount of monomers. When the addition amount of the chelating agent is too small, metal ions entering during the preparation of the latex polymer are not sufficiently trapped, and the stability of the latex against aggregation is lowered, whereby the coating properties become worse. When the amount is too large, the viscosity of the latex increases, whereby the coating properties are lowered.

In the preparation of the latex polymer to be used in the present invention, it is preferable to use a chain transfer agent. As the chain transfer agent, ones described in Polymer Handbook (3rd Edition) (Wiley-Interscience, 1989) are preferable. Sulfur compounds are more preferable because they have high chain-transfer ability and because the required amount is small. Especially, hydrophobic mercaptane-based chain transfer agents, such as tert-dodecylmercaptane and n-dodecylmercaptane are preferable.

The amount of the chain transfer agent to be added is preferably 0.2 mass % to 2.0 mass %, more preferably 0.3 mass % to 1.8 mass %, and especially preferably 0.4 mass % to 1.6 mass %, based on the total amount of monomers.

Besides the foregoing compounds, in the emulsion polymerization, use can be made of additives, such as electrolytes, stabilizers, thickeners, defoaming agents, antioxidants, vulcanizers, antifreezing agents, gelling agents, and vulcanization accelerators, as described, for example, in Synthetic Rubber Handbook.

In the coating solution of the latex polymer to be used in the present invention, an aqueous solvent can be used as the solvent, and a water-miscible organic solvent may optionally be used in combination. Examples of the water-miscible organic solvent include alcohols (for example, methyl alcohol, ethyl alcohol, and propyl alcohol), cellosolves (for example, methyl cellosolve, ethyl cellosolve, and butyl cellosolve), ethyl acetate, and dimethylformamide. The amount of the organic solvent to be added is preferably 40 mass % or less of the entire solvent, more preferably 30 mass % or less of the entire solvent.

Furthermore, in the latex polymer to be used in the present invention, the polymer concentration is, based on the amount of the latex liquid, preferably 10 mass % to 70 mass %, more preferably 20 mass % to 60 mass %, and especially preferably 30 mass % to 55 mass %.

The amount of the latex polymer to be added is preferably 50 to 95% by mass and more preferably 70 to 90% by mass in terms of its solid content based on all polymers in the receptor layer.

The latex polymer in the image-receiving sheet of the present invention includes a state of a gel or dried film formed by removing a part of solvents by drying after coating.

<Ultraviolet Absorber>

Also, in the present invention, in order to improve light resistance, an ultraviolet absorber may be added to the receptor layer. In this case, when this ultraviolet absorber is made to have a higher molecular mass, it can be secured to the receptor layer so that it can be prevented, for instance, from being diffused into the ink sheet and from being sublimated and vaporized by heating.

As the ultraviolet absorber, compounds having various ultraviolet absorber skeletons, which are widely known in the field of information recording, may be used. Specific examples of the ultraviolet absorber may include compounds having a 2-hydroxybenzotriazole-type ultraviolet absorber skeleton, 2-hydroxybenzotriazine-type ultraviolet absorber skeleton, or 2-hydroxybenzophenon-type ultraviolet absorber skeleton. Compounds having a benzotriazole-type or triazine-type skeleton are preferable from the viewpoint of ultraviolet absorbing ability (absorption coefficient) and stability, and compounds having a benzotriazole-type or benzophenone-type skeleton are preferable from the viewpoint of obtaining a higher-molecular mass and using in a form of a latex. Specifically, ultraviolet absorbers described in, for example, JP-A-2004-361936 may be used.

The ultraviolet absorber preferably absorbs light at wavelengths in the ultraviolet region, and the absorption edge of the absorption of the ultraviolet absorber is preferably out of the visible region. Specifically, when it is added to the receptor layer to form a heat-sensitive transfer image-receiving sheet, the heat-sensitive transfer image-receiving sheet has a reflection density of, preferably, Abs 0.5 or more at 370 nm, and more preferably Abs 0.5 or more at 380 n. Also, the heat-sensitive transfer image-receiving sheet has a reflection density of, preferably, Abs 0.1 or less at 400 nm. If the reflection density at a wavelength range exceeding 400 nm is high, it is not preferable because an image is made yellowish.

In the present invention, the ultraviolet absorber is preferably made to have a higher molecular mass. The ultraviolet absorber has a mass average molecular mass of preferably 10,000 or more, and more preferably 100,000 or more. As a means of obtaining a higher-molecular mass ultraviolet absorber, it is preferable to graft an ultraviolet absorber on a polymer. The polymer as the principal chain preferably has a polymer skeleton less capable of being dyed than the receptor polymer to be used together. Also, when the polymer is used to form a film, the film preferably has sufficient film strength. The graft ratio of the ultraviolet absorber to the polymer principal chain is preferably 5 to 20% by mass, more preferably 8 to 15% by mass.

Furthermore, it is more preferable that the ultraviolet-absorber-grafted polymer is made to be used in a form of a latex. When the polymer is made to be used in a form of a latex, an aqueous dispersion-system coating solution may be used in application and coating to form the receptor layer, and this enables reduction of production cost. As a method of making the latex polymer (or making the polymer latex-wise), a method described in, for example, Japanese Patent No. 3450339, may be used. As the ultraviolet absorber to be used in a form of a latex, the following commercially available ultraviolet absorbers may be used, which include ULS-700, ULS-1700, ULS-1383MA, ULS-1635MH, XL-7016, ULS-933LP, and ULS-935LH, manufactured by Ipposha Oil Industries Co., Ltd.; and New Coat UVA-1025W, New Coat UVA-204W, and New Coat UVA-4512M, manufactured by Shin-Nakamura Chemical Co., Ltd. (all of these names are trade names).

In the case of making an ultraviolet-absorber-grafted polymer into a form of a latex, it may be mixed with a latex of the receptor polymer capable of being dyed, and the resultant mixture is to be used for coating. By doing so, a receptor layer, in which the ultraviolet absorber is homogeneously dispersed, can be formed.

The addition amount of the ultraviolet-absorber-grafted polymer or its latex is preferably 5 to 50 parts by mass, more preferably 10 to 30 parts by mass, to 100 parts by mass of the latex of the receptor polymer capable of being dyed, which receptor polymer is to be utilized to form the receptor layer.

<Releasing Agent>

In order to prevent thermal fusion with the heat-sensitive transfer sheet at the time of image formation, a releasing agent may be compounded in the receptor layer. As the releasing agent, a silicone oil, a phosphate-based releasing agent (a phosphate-based plasticizer), a fluorine-series compound, or various wax dispersions may be used, and the silicone oil and the wax dispersions are particularly preferably used.

As the silicone oil, modified silicone oil, such as epoxy-modified, alkyl-modified, amino-modified, carboxyl-modified, alcohol-modified, fluorine-modified, alkyl aralkyl polyether-modified, epoxy/polyether-modified, or polyether-modified silicone oil, is preferably used. Among these, a reaction product between vinyl-modified silicone oil and hydrogen-modified silicone oil is preferable. The amount of the releasing agent is preferably 0.2 to 30 parts by mass, per 100 parts by mass of the receptor polymer.

As the wax dispersions, known dispersions may be used. In the present invention, "wax" means an organic compound having an alkyl chain which is in a solid or semisolid state at room temperature (according to the definition given in *Kaitei Wax no Seishitsu to Oyo* (Revised edition, Properties and Applications of Wax), Saiwai Shobo (1989)). Preferable examples of the organic compound include candelilla wax, carnauba wax, rice wax, haze wax, montan wax, ozokerite, paraffin wax, microcrystalline wax, petrolatum, Fischer-Tropsch wax, polyethylene wax, montan wax derivatives, paraffin wax derivatives, microcrystalline wax derivatives, hydrogenated ricinus, hydrogenated ricinus derivatives, 12-hydroxystearic acid, stearic acid amide, phthalic anhydride imide, chlorinated hydrocarbons, and other mixed waxes. Of these waxes, carnauba wax, montan wax and derivatives thereof, paraffin wax and derivatives thereof, microcrystalline wax and derivatives thereof, polyethylene wax and stearic acid amide are preferred; carnauba wax, montan wax and derivatives thereof, microcrystalline wax and stearic acid amide are more preferred; montan wax, montan wax derivatives and microcrystalline wax are further preferred.

The wax is selected from wax having melting points of generally 25° C. to 120° C., preferably 40° C. to 100° C., more preferably 60° C. to 90° C.

<Emulsion>

Hydrophobic additives, such as a lubricant, an antioxidant, and the like, can be introduced into a layer of the image-receiving sheet (e.g. the receptor layer, the heat insulation layer, the intermediate layer, the undercoat layer), by using a known method described in U.S. Pat. No. 2,322,027, or the like. In this case, a high-boiling organic solvent, as described in U.S. Pat. No. 4,555,470, No. 4,536,466, No. 4,536,467, No. 4,587,206, No. 4,555,476 and No. 4,599,296, JP-B-3-62256, and the like, may be used singly or in combination with a low-boiling organic solvent having a boiling point of 50 to 160° C., according to the need. Also, these lubricants, antioxidants, and high-boiling organic solvents may be respectively used in combination of two or more of those.

As the lubricant, solid waxes such as polyethylene wax, amide wax and Teflon (registered trade name) powder; silicone oil, phosphate-series compounds, fluorine-based surfactants, silicone-based surfactants and others including releasing agents known in the technical fields concerned may be used. Among these, various waxes, fluorine-series compounds typified by fluorine-based surfactants, silicone-based surfactants and silicone-series compounds such as silicone oil and/or its hardened products are preferably used.

<Surfactant>

Further in the heat-sensitive transfer image-receiving sheet of the present invention, a surfactant may be contained in any of such layers as described above. Of these layers, it is preferable to contain the surfactant in a receptor layer and an intermediate layer.

An addition amount of the surfactant is preferably from 0.01% by mass to 5% by mass, more preferably from 0.01% by mass to 1% by mass, and especially preferably from 0.02% by mass to 0.2% by mass, based on the total solid content.

With respect to the surfactant, various kinds of surfactants such as anionic, nonionic and cationic surfactants are known. As the surfactant that can be used in the present invention, any known surfactants may be used. For example, it is possible to use surfactants as reviewed in "Kinosei kaimenkasseizai (Functional Surfactants)", editorial supervision of Mitsuo Tsunoda, edition on August in 2000, Chapter 6. Of these surfactants, fluorine-containing anionic surfactants are preferred.

Without any surfactant, a coating operation is possible. However, because surface tension of a coating liquid is high, a coated surface state sometimes becomes lack of uniformity, which results in unevenness. By containing a surfactant to a coating liquid, surface tension of the coating liquid reduces. Thereby unevenness at the time of coating is eliminated and a coated surface state is made uniform. Consequently, a coating operation can be performed stably.

Specific examples of the fluorine compounds are set forth below. However, the fluorine compounds that can be used in the present invention are not by any means limited to the following examples. Herein, an alkyl group and a perfluoroalkyl group each means a group having a straight chain structure, unless otherwise indicated in their descriptive structures of the following exemplified compounds.

BFS-1

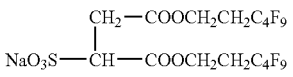

BFS-2

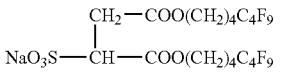

BFS-3

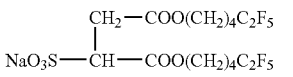

-continued

BFS-4

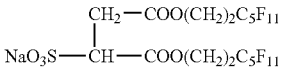

BFS-5

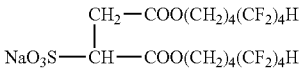

BFS-6

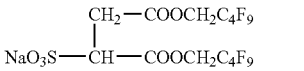

BFS-7

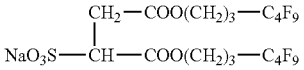

BFS-8

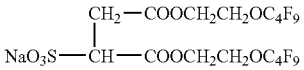

BFS-9

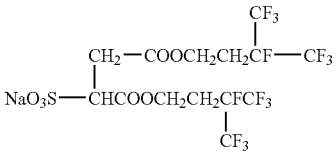

BFS-10

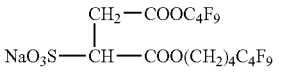

BFS-11

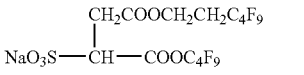

BFS-12

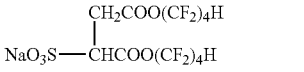

BFS-13

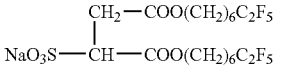

BFS-14

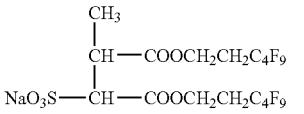

BFS-15

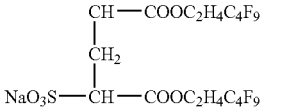

These fluorine compounds are used as a surfactant in coating compositions used to form layers (especially, a receptor layer, a heat insulation layer, an intermediate layer, a subbing layer, a back layer, etc.) by which a heat-sensitive transfer image-receiving sheet is composed. In the present invention, they are preferably contained in a receptor layer and an intermediate layer.

<Hardening Agent>

A hardening agent that is used in the present invention as a crosslinking agent, may be added to a coating layer of the image-receiving sheet, such as a receptor layer, a heat insulation layer, and a subbing layer.

Preferable examples of the hardening agent (hardener) that can be used in the present invention include H-1, 4, 6, 8, and 14 in JP-A-1-214845 in page 17; compounds (H-1 to H-54) represented by one of formulae (VII) to (XII) in U.S. Pat. No. 4,618,573, columns 13 to 23; compounds (H-1 to H-76) represented by formula (6) in JP-A-2-214852, page 8, the lower right (particularly, H-14); and compounds described in Claim 1 in U.S. Pat. No. 3,325,287. Examples of the hardening agent include hardening agents described, for example, in U.S. Pat. No. 4,678,739, column 41, U.S. Pat. No. 4,791,042, JP-A-59-116655, JP-A-62-245261, JP-A-61-18942, and JP-A-4-218044. More specifically, an aldehyde-series hardening agent (formaldehyde, etc.), an aziridine-series hardening agent, an epoxy-series hardening agent, a vinyl sulfone-series hardening agent (N,N'-ethylene-bis(vinylsulfonylacetamido) ethane, etc.), an N-methylol-series hardening agent (dimethylol urea, etc.), a boric acid, a metaboric acid, or a polymer hardening agent (compounds described, for example, in JP-A-62-234157), can be mentioned.

Preferable examples of the hardener include a vinylsulfone-series hardener and chlorotriazines.

More preferable hardeners in the present invention are compounds represented by formula (B) or (C).

$$(CH_2{=}CH{-}SO_2)_n\text{-}L \qquad \text{Formula (B)}$$

$$(X{-}CH_2{-}CH_2{-}SO_2)_n\text{-}L \qquad \text{Formula (C)}$$

In formulae (B) and (C), X represents a halogen atom, L represents an organic linking group having n-valency. When the compound represented by formula (B) or (C) is a low-molecular compound, n denotes an integer from 1 to 4. When the compound represented by formula (B) or (C) is a high-molecular (polymer) compound, L represents an organic linking group containing a polymer chain, and n denotes an integer in the range of from 10 to 1,000.

In formulae (B) and (C), X is preferably a chlorine atom or a bromine atom, and further preferably a bromine atom. n is an integer from 1 to 4, preferably an integer from 2 to 4, more preferably 2 or 3, and most preferably 2.

L represents an organic group having n-valency, and preferably an aliphatic hydrocarbon group, an aromatic hydrocarbon group or a heterocyclic group, and any of these groups may be combined through an ether bond, ester bond, amide bond, sulfonamido bond, urea bond, urethane bond, or the like. Also, each of these groups may be further substituted. Examples of the substituent include halogen atom, alkyl group, aryl group, heterocyclic group, hydroxyl group, alkoxy group, aryloxy group, alkylthio group, arylthio group, acyloxy group, alkoxycarbonyl group, carbamoyloxy group, acyl group, acyloxy group, acylamino group, sulfonamido group, carbamoyl group, sulfamoyl group, sulfonyl group, phosphoryl group, carboxyl group, or sulfo group. Among these groups, a halogen atom, alkyl group, hydroxy group, alkoxy group, aryloxy group, or acyloxy group is preferable.

These hardeners are used in an amount of generally 0.001 to 1 g, preferably 0.005 to 0.5 g, per g of the water-soluble polymer.

<Antiseptic>

If a coating liquid, an image-receiving sheet, a print image and the like are reserved, microorganism (especially, bacteria, mold, yeast, etc.) attaches to these materials during reservation, thereby to reduce their capacities in many cases. In order to prevent from reduction in the capacity, an antiseptic may be contained in the coating liquid and the like in such a degree that other capacities are not adversely affected by the antiseptics.

The term "antiseptic" used in the present invention means a compound that is used to prevent a compound for use in the image-receiving sheet from being subjected to decomposition reaction caused by growth of microorganism. Representation by formula and specific compounds are described in, for example, "Boufu Boukabi Handobukku (Hand book of antiseptic treatment and fungusproofing)", Gihoudo Shuppan (1986); "Boukin Boukabi no Kagaku (Chemistry of bacteria resistance and fungusproofing)", authored by Hiroshi Horiguchi, Sankyo Shuppan (1986); and "Boukin Boukabizai Jiten (Encyclopedia of bacteria resisting agents and fungusproofing agents)", published by Nippon Boukin Boukabi Gakkai (1986).

The antiseptic to be contained in the image-receiving sheet of the present invention are not particularly limited. Examples of the antiseptics include phenol or its derivatives, formalin, imidazole derivatives, sodium dehydroacetate, 4-isothiazoline-3-on derivatives, benzoisothiazoline-3-on, benzotriazole derivatives, amidineguanidine derivatives, quaternary ammonium salts, pyrrolidine, quinoline, guanidine derivatives, diazine, triazole derivatives, oxazole, oxazine derivatives, 2-mercaptopyridine-N-oxide or its salt, and formaldehyde donor-series antibacterial agent. Of these antiseptics, materials such as phenol or its derivatives, 4-isothiazoline-3-on derivatives, and benzoisothiazoline-3-on are preferred.

Beside, compounds represented by any one of formulae (I) to (IV) set forth below may be used as antiseptics.

Formula (I)

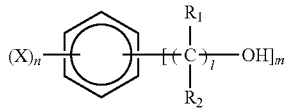

In formula (I), $R_1$ and $R_2$, which may be the same or different, each represent a hydrogen atom, a hydroxyl group, or a lower alkyl group. X represents a hydrogen atom, a halogen atom, a nitro atom, a cyano group, an aryl group, a lower alkyl group, a lower alkenyl group, an aralkyl group, an alkoxy group, $—COR_3$, $—SO_2R_4$, or $—N(R_5)R_6$. $R_3$ and $R_4$ each represent a hydrogen atom, —OM, a lower alkyl group, a lower alkoxy group, or $—N(R_7)R_8$.

$R_5$ and $R_6$, which may be the same or different, each represents a hydrogen atom, a lower alkyl group, $—COR_9$, or $—SO_2R_{10}$. $R_9$ and $R_{10}$ each represent a lower alkyl group, or $—N(R_{11})R_{12}$. $R_7$, $R_8$, $R_{11}$ and $R_{12}$, which may be the same or different, each independently represents a hydrogen atom, or a lower alkyl group.

M represents a hydrogen atom, an alkali metal atom, or atoms necessary for forming a univalent cation. l represents an integer of from 2 to 6. m represents an integer of from 1 to 4. n represents an integer of 6-m. When a plurality of $R_1$, $R_2$, or X is present, they may be different from each other, respectively.

Formula (II)

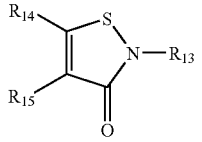

In formula (II), $R_{13}$ represents a hydrogen atom, an alkyl group, an alkenyl group, an aralkyl group, an aryl group, a heterocyclic group,

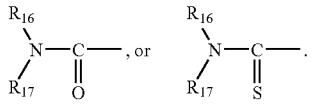

$R_{14}$ and $R_{15}$ each represent a hydrogen atom, a halogen atom, an alkyl group, an aryl group, a cyano group, a heterocyclic group, an alkylthio group, an alkylsulfoxyl group, or an alkylsulfonyl group. $R_{14}$ and $R_{15}$ may bond together to form an aromatic ring.

$R_{16}$ and $R_{17}$ each represent a hydrogen atom, an alkyl group, an aryl group, or an aralkyl group.

Of these compounds represented by formula (II), preferred is the compound in which $R_{14}$ and $R_{15}$ are each a hydrogen atom and $R_{13}$ is a methyl group. Hereinafter, said specific compound is designated as Compound II-a. It is more preferred to combine Compound II-a and the compound in which $R_{14}$ and $R_{15}$ bond together to form an aromatic ring and $R_{13}$ is a methyl group, or alternatively to combine Compound II-a and the compound in which $R_{14}$ is a chlorine atom, $R_{15}$ is a hydrogen atom and $R_{13}$ is a methyl group.

Formula (III)

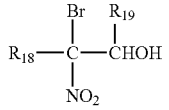

In formula (III), $R_{18}$ represents a hydrogen atom, an alkyl group, or a hydroxymethyl group; and $R_{19}$ represents a hydrogen atom or an alkyl group.

Formula (IV)

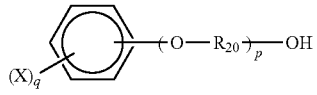

In formula (IV), $R_{20}$ represents a lower alkylene group. X represents a hydrogen atom, a halogen atom, a nitro atom, a hydroxyl group, a cyano group, a lower alkyl group, a lower alkoxy group, —$COR_{21}$, —$N(R_{22})R_{23}$, or —$SO_3M$. $R_{21}$ represents a hydrogen atom, —OM, a lower alkyl group, an aryl group, an aralkyl group, a lower alkoxy group, an aryloxy group, an aralkyloxy group, or —$N(R_{24})R_{25}$.

$R_{22}$ and $R_{23}$, which may be the same or different, each represent a hydrogen atom, a lower alkyl group, an aryl group, an aralkyl group, —$COR_{26}$, or —$SO_2R_{26}$. $R_{24}$ and $R_{25}$, which may be the same or different, each represent a hydrogen atom, a lower alkyl group, an aryl group, or an aralkyl group. $R_{26}$ represents a lower alkyl group, an aryl group, or an aralkyl group. M represents a hydrogen atom, an alkali metal atom, or atoms necessary for forming a univalent cation. p represents 0 or 1. q represents 0 or an integer of from 1 to 5.

As the antiseptics, one kind material may be used alone. Alternatively, two or more kinds of arbitrary materials may be used in combination. The antiseptic may be added as it is, or may be added as a solution of the antiseptic dissolved in water or an organic solvent such as methanol, ethanol, isopropyl alcohol, acetone, ethylene, and ethylene glycol, to a coating liquid for the image-receiving sheet. Alternatively, the antiseptics may be added to latex. Beside, after dissolving antiseptics in a high boiling solvent or a low boiling solvent, or a mixture thereof, followed by emulsion dispersion in the presence of a surfactant, the resultant dispersion of the antiseptics may be added to latex.

<Matting Agent>

In the present invention, a matting agent is preferably contained for providing releasing property with the image-receiving sheet. The matting agent is preferably added to the outermost layer or the layer that functions as the outermost layer or a layer close to the outermost layer of the heat-sensitive transfer image-receiving sheet. The outermost layer may be composed of two layers, if necessary. Most preferably, the matting agent is added to the receptor layer disposed as the outermost layer. Besides, the matting agent may be added to the outermost layer on the same side as the image-forming side and/or the outermost layer at the back side. In the present invention, it is especially preferred that the matting agent is contained on the same side as the layer containing a sliding agent with respect to the support.

In the present invention, it is preferred that a matting agent is previously dispersed with a binder so that the matting agent can be used as a dispersion of matting agent particles.

Examples of the matting agent generally include fine particles of water-insoluble organic compounds and fine particles of water-insoluble inorganic compounds. In the present invention, organic compound-containing fine particles are preferably used from the viewpoints of dispersion properties. In so far as an organic compound is incorporated in the particles, they may be organic compound particles consisting of the organic compound alone, or alternatively organic/inorganic composite particles containing not only the organic compound but also an inorganic compound. As the matting agent, there can be used those materials well known in the field of silver halide photosensitive materials, such as organic matting agents described in, for example, U.S. Pat. No. 1,939,213, No. 2,701,245, No. 2,322,037, No. 3,262,782, No. 3,539,344, and No. 3,767,448.

It is preferred that the matting agent has a heat resistance because a surface temperature of the receptor layer becomes high at the time of graphic printing.

In the present invention, a preferable matting agent is composed of the polymer such as the above-described organic compounds, in which the polymer has a thermal decomposition temperature of 200° C. or more, more preferably 240° C. or more.

Besides, a hard matting agent is preferred because not only heat but also pressure is applied to the surface of the receptor layer at the time of graphic printing.

It is preferred that the matting agent preferably contained in the outermost layer and/or a layer adjacent to the outermost layer on the same side as an image-forming layer is previously dispersed with a binder and used as a dispersion of matting agent particles. As the method for dispersion, there are two methods, namely (a) a method of preparing dispersions of the matting agent, comprising the steps of preparing a solution of a polymer to be as a matting agent (for example, dissolving the polymer in a low boiling-point solvent), emulsifying and dispersing the solution in an aqueous medium to obtain droplets of the polymer, and then eliminating the low boiling-point solvent from the resultant emulsion, and (b) a method of preparing of dispersions, comprising the steps of previously preparing fine particles, including a polymer, to be as a matting agent, and then dispersing the fine particles in an aqueous medium while preventing from generation of aggregate. In the present invention, preferred is the method (b) that does not discharge such a low boiling-point solvent to environments from the environmental concern.

To the dispersions of the matting agent in the present invention, a surfactant is preferably added for stabilization of the dispersed state.

(Intermediate Layer)

An intermediate layer may be formed between the receptor layer and the support. As the intermediate layer, for example, any one or more layer selected from a white background controlling layer, a charge-controlling layer, an adhesive layer, a primer layer, and an undercoat layer is formed. These layers may be formed in the same manner as those described in, for example, each specification of Japanese Patent Nos. 3585599 and 2925244.

(Support)

In the present invention, it is preferred to use a water-proof support as the support. The use of the waterproof support makes it possible to prevent the support from absorbing moisture, whereby a fluctuation in the performance of the receptor layer with the lapse of time can be prevented. As the waterproof support, for example, coated paper or laminate paper may be used. Especially, a laminated paper is preferred in terms of surface smoothness. It is suitable to use a similar article to a polyethylene laminated paper (this paper is sometimes abbreviated as a WP paper) that is used for a photographic printing paper in the field of silver salt photography, namely a paper composed of cellulose as a main component in which at least one surface of said paper at the same side as the receptor layer-coating side is laminated with a polyolefin resin.

Coated Paper

The coated paper is paper obtained by coating a sheet, such as base paper, with any of various resins, rubber latexes, or high-molecular materials, on one side or both sides of the sheet, in which the coating amount differs depending on its use. Examples of such coated paper include art paper, cast coated paper, and Yankee paper.

It is preferable to use a thermoplastic resin as the resin to be applied to the surface(s) of the base paper and the like. As such a thermoplastic resin, the following thermoplastic resins (A) to (H) may be exemplified.

(A) Polyolefin resins, such as polyethylene resin and polypropylene resin; copolymer resins composed of an olefin, such as ethylene or propylene, and another vinyl monomer; and acrylic resins.

(B) Thermoplastic resins having an ester linkage: for example, polyester resins obtained by condensation of a dicarboxylic acid component (such a dicarboxylic acid component may be substituted with a sulfonic acid group, a carboxyl group, or the like) and an alcohol component (such an alcohol component may be substituted with a hydroxyl group, or the like); polyacrylate resins or polymethacrylate resins, such as polymethyl methacrylate, polybutyl methacrylate, polymethyl acrylate, polybutyl acrylate, or the like; polycarbonate resins, polyvinyl acetate resins, styrene acrylate resins, styrene/methacrylate copolymer resins, vinyltoluene acrylate resins, or the like.

Concrete examples of them are those described in JP-A-59-101395, JP-A-63-7971, JP-A-63-7972, JP-A-63-7973, and JP-A-60-294862.

Commercially available thermoplastic resins usable herein are, for example, Vylon 290, Vylon 200, Vylon 280, Vylon 300, Vylon 103, Vylon GK-140, and Vylon GK-130 (products of Toyobo Co., Ltd.); Tafton NE-382, Tafton U-5, ATR-2009, and ATR-2010 (products of Kao Corporation); Elitel UE 3500, UE 3210, XA-8153, KZA-7049, and KZA-1449 (products of Unitika Ltd.); and Polyester TP-220, and R-188 (products of The Nippon Synthetic Chemical Industry Co., Ltd.); and thermoplastic resins in the Hyros series from Seiko Chemical Industries Co., Ltd., and the like (all of these names are trade names).

(C) Polyurethane resins, etc.

(D) Polyamide resins, urea resins, etc.

(E) Polysulfone resins, etc.

(F) Polyvinyl chloride resins, polyvinylidene chloride resins, vinyl chloride/vinyl acetate copolymer resins, vinyl chloride/vinyl propionate copolymer resins, etc.

(G) Polyol resins, such as polyvinyl butyral; and cellulose resins, such as ethyl cellulose resin and cellulose acetate resin.

(H) Polycaprolactone resins, styrene/maleic anhydride resins, polyacrylonitrile resins, polyether resins, epoxy resins, and phenolic resins.

The thermoplastic resins may be used either singly or in combination of two or more of those.

The thermoplastic resin may contain or may have contained a whitener, a conductive agent, a filler, a pigment or dye including, for example, titanium oxide, ultramarine blue, and carbon black; or the like, if necessary.

Laminated Paper

The laminated paper is a paper which is formed by laminating any of various kinds of resins, rubbers, polymer sheets or films, on a sheet, such as a base paper or the like. Specific examples of the materials useable for the lamination include polyolefins, polyvinyl chlorides, polyethylene terephthalates, polystyrenes, polymethacrylates, polycarbonates, polyimides, and triacetylcelluloses. These resins may be used either singly or in combination of two or more of those.

Generally, the polyolefins are prepared by using a low-density polyethylene, in many cases. In the present invention, however, for improving the thermal resistance of the support, it is preferred to use a polypropylene, a blend of a polypropylene and a polyethylene, a high-density polyethylene, or a blend of a high-density polyethylene and a low-density polyethylene. From the viewpoint of cost and its suitableness for the lamination, it is particularly preferred to use the blend of a high-density polyethylene and a low-density polyethylene.

The blend of a high-density polyethylene and a low-density polyethylene is used in a blend ratio (a mass ratio) of generally 1/9 to 9/1, preferably 2/8 to 8/2, and more preferably 3/7 to 7/3. When the thermoplastic resin layer is formed on each surface of the support, the back side of the support is preferably formed using, for example, the high-density polyethylene, or the blend of a high-density polyethylene and a low-density polyethylene. The molecular mass of the polyethylenes is not particularly limited. Preferably, the high-density polyethylene and the low-density polyethylene each have a melt index of 1.0 to 40 g/10-min and a high extrudability.

The sheet or film may be subjected to a treatment to impart white reflection thereto. As a method of such a treatment, for example, a method of incorporating a pigment, such as titanium oxide, into the sheet or film, can be mentioned. The thus-processed paper is generally used as a support for a photographic printing paper in the field of silver salt photography. This paper is sometimes abbreviated as a WP paper.

The thickness of the support is preferably from 25 μm to 300 μm, more preferably from 50 μm to 260 μm, and further preferably from 75 μm to 220 μm. The support can have any rigidity according to the purpose. When it is used as a support for a heat-sensitive transfer image-receiving sheet of photographic image quality, the rigidity thereof is preferably near to that in a support for use in color silver halide photography.

(Curling-Control Layer)

When the support is exposed as it is, there is the case where the heat-sensitive transfer image-receiving sheet is made to curl by moisture and/or temperature in the environment. It is therefore preferable to form a curling-control layer on the backside of the support. The curling-control layer not only prevents the image-receiving sheet from curling but also has a water-proof function. For the curling-control layer, a polyethylene laminate, a polypropylene laminate, or the like is used. Specifically, the curling-control layer may be formed in a manner similar to those described in, for example, JP-A-61-110135 and JP-A-6-202295.

(Writing Layer and Charge-Controlling Layer)

For the writing layer and the charge-control layer, an inorganic oxide colloid, an ionic polymer, or the like may be used. As the antistatic agent, use may be made of any antistatic agents including cationic antistatic agents, such as a quaternary ammonium salt and polyamine derivative, anionic antistatic agents, such as alkyl phosphate, and nonionic antistatic agents, such as fatty acid ester. Specifically, the writing layer and the charge-control layer may be formed in a manner similar to those described in the specification of Japanese Patent No. 3585585.

The method of producing the heat-sensitive transfer image-receiving sheet of the present invention is explained below.

The heat-sensitive transfer image-receiving sheet of the present invention is produced by coating at least one receptor layer and at least one heat insulation layer on a support with using a water-based coating liquid. The coating method can be properly selected from a known method to perform a coating operation.

The embodiments where both or one of the receptor layer and the heat insulation layer are composed of two or more layers are preferable. At least, if constitutional layers adjacent to each other are to be coated with using water-based coating liquids, it is preferred that these layers be coated according to a simultaneous multilayer coating method.

It is known that in the case of producing an image-receiving sheet composed of plural layers having different functions from each other (for example, an air cell layer, a heat insulation layer, an intermediate layer, and a receptor layer) on a support, it may be produced by applying each layer successively one by one, or by overlapping the layers each already coated on a support, as shown in, for example, JP-A-2004-106283, JP-A-2004-181888 and JP-A-2004-345267. It has been known in photographic industries, on the other hand, that productivity can be greatly improved, for example, by providing plural layers through simultaneous multi-layer coating. For example, there are known methods, such as the so-called slide coating (slide coating method) and curtain coating (curtain coating method), as described in, for example, U.S. Pat. Nos. 2,761,791, 2,681,234, 3,508,947, 4,457,256 and 3,993,019; JP-A-63-54975, JP-A-61-278848, JP-A-55-86557, JP-A-52-31727, JP-A-55-142565, JP-A-50-43140, JP-A-63-80872, JP-A-54-54020, JP-A-5-104061, JP-A-5-127305, and JP-B-49-7050; and Edgar B. Gutoff, et al. and "Coating and Drying Defects: Troubleshooting Operating Problems", John Wiley & Sons, 1995, pp. 101-103. In these coating methods, a plurality of coating liquids is simultaneously fed to a coating apparatus to form different multi layers.

In the present invention, effects of the invention are successfully realized by using a simultaneous multilayer coating method to produce a multilayer image-receiving sheet. At the same time, it is possible to obtain a heat-sensitive transfer image-receiving sheet that is excellent in traveling (transport property) at the time when the image-receiving sheet is superposed on an ink sheet to make a print. Besides, it is also possible to obtain a heat-sensitive transfer image-receiving sheet that is excellent in adherence between coating layers, so that film peeling seldom arises even if the image-receiving sheet is repeatedly put on a notice board with an adhesive tape. In addition, productivity can be sharply improved.

In the simultaneous multilayer coating method, it is necessary to adjust both viscosity and surface tension of coating liquids used for forming layers in terms of uniform coating formation and good coating property. The viscosity of coating liquid can be easily adjusted using known thickeners or viscosity reducers in such a degree that they do not affect to other performances. Beside, the surface tension of coating liquid can be adjusted using various kinds of surfactants.

The plural layers in the present invention are structured using resins as their major components. Coating solutions for forming each layer are preferably polymer latexes. The solid content by mass of the resin put in a latex state in each layer coating solution is preferably in the range from 5 to 80% and particularly preferably 20 to 60%. The average particle size of the resin contained in the above polymer latex is preferably 5 μm or less and particularly preferably 1 μm or less. The above polymer latex may contain a known additive, such as a surfactant, a dispersant, and a binder resin, according to the need.

The temperature of these coating liquids is preferably in the range of from 30° C. to 60° C., and more preferably from 35° C. to 50° C.

In the present invention, it is preferred that a laminate composed of plural layers be formed on a support and solidified just after the forming, according to the method described in U.S. Pat. No. 2,761,791. For example, in the case of solidifying a multilayer structure by using a resin, it is preferable to raise the temperature immediately after the plural layers are formed on the support. On the other hand, in the case where the layer contains a binder capable of gelling at a lower temperature as exemplified by gelatin, it is sometimes preferred that temperature is lowered promptly after forming multiple layers on a substrate so as to solidify the resultant coatings by cooling, and then the temperature is elevated to dry.

As an example of the method of lowering temperature, there is a method of blowing a cold air or the like to a coating. The temperature of cold air is preferably not more than 25° C., more preferably not more than 15° C., and especially preferably not more than 10° C. Beside, a period of time in which a coating is blued with a cold air varies depending on a traveling speed of the coating, but a preferable period of time is 15 seconds or more. In order to accelerate gelation, not only a ratio by mass of the binder is increased, but also a known gelling agent is used.

In the present invention, the coating amount of a coating solution per one layer constituting the multilayer structure is preferably in the range from 1 g/m$^2$ to 500 g/m$^2$. The number of layers in the multilayer structure may be arbitrarily selected from a number of 2 or more. The receptor layer is preferably provided as a layer most apart from the support.

The heat-sensitive transfer image-receiving sheet of the present invention is coated according to the above-described method, preferably a simultaneous multilayer coating method, and then dried. On account that latex is a main component of the coating liquid in the present invention, if the coating liquid is rapidly dried, shrinkage of the film caused by drying does not arise uniformly, so that crazing (cracking) becomes easy to arise in a coating after drying. For this reason, a slow drying is preferred.

In order to satisfy these requirements, it is necessary in the drying step to regulate a drying temperature, a dry air quantity, and a dew point of a dry air and to dry the coating while controlling a drying rate.

A heat-sensitive transfer sheet (an ink sheet) that is used in combination with the heat-sensitive transfer image-receiving sheet of the present invention as mentioned above, at the time of formation of a heat transfer image, is, for example, a sheet having on a support a dye layer containing a diffusion-transfer dye, and any ink sheet can be used as the sheet. As a means for providing heat energy in the thermal transfer, any of the known providing means may be used. For example, application of a heat energy of about 0 to 50 mJ/mm$^2$ by controlling the recording time in a recording device, such as a thermal printer (e.g., trade name: ASK-2000, manufactured by FUJIFILM Corporation), sufficiently attains the expected result.

Also, the heat-sensitive transfer image-receiving sheet of the present invention may be used in various applications enabling thermal transfer recording, such as heat-sensitive transfer image-receiving sheets in a form of thin sheets (cut sheets) or rolls; cards; and transmittable-type manuscript-making sheets, by appropriately selecting the type of support.

The present invention can be applied to a printer, a copying machine, and the like, each of which uses a heat-sensitive transfer recording system.

The present invention will be described in more detail based on the following examples, but the invention is not intended to be limited thereto.

EXAMPLES

In the following Examples, the terms "part" and "%" are values by mass, unless they are indicated differently in particular.

(Preparation of Image-Receiving Sheet)

A paper support, on both surfaces of which polyethylene was laminated, was subjected to corona discharge treatment on the surface thereof. An image-receiving sheet (Sample 101) was prepared by coating, on the paper support, to form a multilayer structure having a subbing layer 1, a subbing layer 2, a heat insulation layer, and a receptor layer, in increasing order of distance from the support. The compositions and coated amounts of the coating solutions to be used are shown below.

As to the coating, all of the layers set forth below were coated according to a simultaneous multilayer coating method. The simultaneous multi-layer coating was carried out, according to the slide coating method described above, and after coating, the thus-coated product was passed through a set zone at 6° C. for 30 seconds to lose fluidity, followed by drying by spraying a drying air at 22° C. and 45% RH on the coated surface for 2 minutes.

| | |
|---|---|
| Coating solution for subbing layer 1 (Composition) | |
| Aqueous solution, prepared by adding 1% of sodium dodecylbenzenesulfonate to a 3% aqueous gelatin solution | |
| NaOH for adjusting pH to 8 | |
| (Coating amount) | 11 ml/m$^2$ |
| Coating solution for subbing layer 2 (Composition) | |
| Styrene-butadiene latex (SR103 (trade name), manufactured by Nippon A & L Inc.) | 60 parts by mass |
| Aqueous 6% gelatin (average molecular mass 20,000) solution | 40 parts by mass |
| Aqueous 1% surfactant solution (BFS-1) | 2 parts by mass |
| NaOH for adjusting pH to 8 | |
| (Coating amount) | 11 ml/m$^2$ |
| (Viscosity of coating liquid) | 50 cp |
| Coating solution for heat insulation layer (Composition) | |
| Emulsified dispersion A prepared below | 21 parts by mass |
| Aqueous 10% gelatin (average molecular mass 20,000) solution | 28 parts by mass |
| Water | 51 parts by mass |
| Antiseptic (compound shown by formula PR-1) | 0.2 parts by mass |
| NaOH for adjusting pH to 8 | |
| (Coating amount) | 50 ml/m$^2$ |
| (Viscosity of coating liquid) | 45 cp |
| Coating solution for receptor layer (Composition) | |
| Emulsified dispersion B prepared below | 4 parts by mass |
| Vinyl chloride-latex polymer (VINYBLAN 900 (trade name), manufactured by Nissin Chemical Industry Co., Ltd.) | 53 parts by mass |
| Vinyl chloride-latex polymer (VINYBLAN 276 (trade name), manufactured by Nissin Chemical Industry Co., Ltd.) | 10 parts by mass |
| Microcrystalline wax (EMUSTAR-42X (trade name), manufactured by Nippon Seiro Co., Ltd.) | 6 parts by mass |
| Water | 22 parts by mass |
| Aqueous 1% surfactant solution (BFS-1) | 4 parts by mass |
| Matting agent (Melamine-silica resin, gravity 1.65, OPTBEADS 3500 M (trade name), manufactured by Nissan Chemical Industries) | 1 parts by mass |
| Antiseptic (compound shown by formula PR-1) | 0.1 parts by mass |
| NaOH for adjusting pH to 8 | |

-continued

| | |
|---|---|
| (Coating amount) | 18 ml/m$^2$ |
| (Viscosity of coating liquid) | 7 cp |

(Formula PR-1)

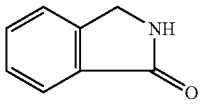

(Preparation of Emulsified Dispersion A)

An emulsified dispersion A was prepared in the following manner. A compound EB-9 was dissolved in a mixture of 42 g of a high-boiling solvent (Solv-5) and 20 ml of ethyl acetate, and the resultant solution was emulsified and dispersed in 250 g of a 20-mass % aqueous gelatin solution containing 1 g of sodium dodecylbenzenesulfonate, by means of a high-speed stirring emulsifier (dissolver). Thereto, water was added, to prepare 380 g of the emulsified dispersion A.

The addition amount of the compound EB-9 was adjusted so that the compound would be contained in an amount of 30 mmol in the emulsified dispersion A. (For reference, chemical formulae of the above-described compounds are set forth below.)

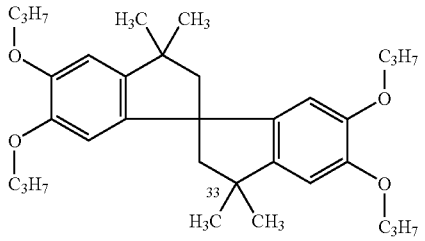

(EB-9)

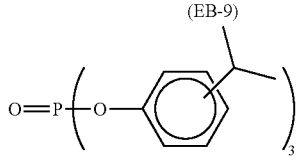

(Solv-5)

(Preparation of Emulsified Dispersion B)

To make a solution, were mixed 11.0 g of high boiling solvent (Solv-5), 9 g of KF-96 (dimethylsilicone, manufactured by Shinetsu Chemical), 15.5 g of (EB-9), 7.5 g of KAYARAD DPCA-30 (trade name, manufactured by Nippon Kayaku) and 20 ml of ethyl acetate. The resultant solution was emulsified and dispersed into 250 g of aqueous 20% gelatin (average molecular mass: 18,000) solution by means of a high speed agitation emulsifier (Disolver), followed by addition of water to make 380 g of Emulsified dispersion B.

Preparation of Sample 102

Sample 102 was prepared in the same manner as sample 101, except that, in the preparation of the heat insulation layer, 48 mass parts of a hollow polymer MH50055 (a product of Nippon Zeon) was further added and the quantity of water was changed from 51 mass parts to 3 mass parts.

Preparation of Sample 103

Sample 103 was prepared in the same manner as sample 102, except that 250 g of aqueous 20% by mass solution of the water-soluble polymer B was added in place of 250 g of gelatin (average molecular mass 18,000) that was used to prepare Emulsion B in the receptor layer.

Preparation of Sample 104

Sample 104 was prepared in the same manner as sample 103, except that a single layer coating was repeated for production rather than the simultaneous multilayer coating.

Preparation of Samples 105 to 119

Samples 105 to 116 were prepared in the same manner as sample 103, except that the water-soluble polymer B in the receptor layer was changed to the water-soluble polymers C to N, respectively. Samples 117 to 119 were prepared in the same manner as sample 103, except that the water-soluble polymer B in the receptor layer was changed to the gelatins O to Q, respectively.

(Preparation of Ink Sheet)

A polyester film 6.0 μm in thickness (trade name: Lumirror, manufactured by Toray Industries, Inc.) was used as the substrate film. A heat-resistant slip layer (thickness: 1 μm) was formed on the back side of the film, and the following yellow, magenta, and cyan compositions were respectively applied as a monochromatic layer (coating amount: 1 g/m$^2$ after drying) on the front side of the film.

| Yellow composition | |
|---|---|
| Yellow dye (trade name: Macrolex Yellow 6G, manufactured by Bayer) | 5.5 parts by mass |
| Polyvinylbutyral resin (trade name: ESLEC BX-1, manufactured by Sekisui Chemical Co., Ltd.) | 4.5 parts by mass |
| Methyl ethyl ketone/toluene (1/1, at mass ratio) | 90 parts by mass |
| **Magenta composition** | |
| Magenta dye (trade name; Disperse Red 60) | 5.5 parts by mass |
| Polyvinylbutyral resin (trade name: ESLEC BX-1, manufactured by Sekisui Chemical Co., Ltd.) | 4.5 parts by mass |
| Methyl ethyl ketone/toluene (1/1, at mass ratio) | 90 parts by mass |
| **Cyan composition** | |
| Cyan dye (Solvent Blue 63) | 5.5 parts by mass |
| Polyvinylbutyral resin (trade name: ESLEC BX-1, manufactured by Sekisui Chemical Co., Ltd.) | 4.5 parts by mass |
| Methyl ethyl ketone/toluene (1/1, at mass ratio) | 90 parts by mass |

(Preparation of Protective Layer Sheet)

On the same polyester film as used for the preparation of ink sheet, were coated a protective layer and an adhesion layer each having the composition set forth below. Dry coating amounts of the protective layer and the adhesion layer were controlled to 1 g/m$^2$ and 0.7 g/m$^2$, respectively. After coating and drying of the protective layer, the adhesion layer was coated on the protective layer.

| Protective layer | |
|---|---|
| Acrylic resin (DIANAL BR-80, trade name, a product of Mitsubishi Rayon) | 20 parts by mass |
| Methyl ethyl ketone/toluene (1/1, at mass ratio) | 80 parts by mass |

-continued

| Adhesion layer | |
|---|---|
| Polyester resin (Trade name: Vylon 220, manufactured by Toyobo Co., Ltd.) | 30 parts by mass |
| Methyl ethyl ketone/toluene (1/1, at mass ratio) | 70 parts by mass |

(Image Formation)

An image with a size of 152 mm×102 mm was output using the above-described ink sheet, protective layer sheet, and image-receiving sheet, by means of a thermal transfer type printer (ASK 2000, manufactured by FUJIFILM Corporation). Herein, a traveling rate was 73 mm/second.

(Evaluation of Performance)

Performances were evaluated in the following terms.

(Image Uniformity and Image Turbulence)

Five sheets of print having a visual density of 0.8 were output successively. Observation by naked eye was performed with respect to the presence of occurrence of white spot, density unevenness, streaked unevenness, and the like of the output prints. Image uniformity was evaluated according to the following grades. The evaluation was each performed by 20 assessors. The average value of their scores was calculated.

5: No image turbulence is found in the print.

4: Almost no image turbulence is found in the print.

3: Image turbulence is found in the print, but the degree of the turbulence is such a level that there is no problem in practical use.

2: Sporadic image turbulence is found in the print, and the degree of the turbulence is such a level that there is a problem in practical use.

1: A lot of image turbulence is found in the print, and the degree of the turbulence is such a level that recognition of the printed image is obscured by the turbulence.

(Presence of Latex Aggregation in Coating Liquid)

Each of the coating liquids was filtrated using a cartridge filter before coating. On that occasion, the coating liquid to which a plugging of the filter was found was judged as a coating liquid in which latex polymer aggregation was present.

(Maximum Transfer Density)

The visual density of the black solid image obtained in the above condition was measured by Photographic Densitometer (trade name, manufactured by X-Rite Incorporated).

The results of evaluation are shown in Table 1.

TABLE 1

| | Heat-insulation-layer coating liquid | Receptor-layer-coating liquid | | Results | | | |
|---|---|---|---|---|---|---|---|
| Sample | Hollow polymer | Water-soluble polymer | Coating method | Generation of aggregation in receptor-layer-coating liquid | Image uniformity evaluation | Coating granular structure | Density |
| Sample 101 (Comparative example) | None | None | Simultaneous multilayer coating | Present | 2 | Present | 1.70 |
| Sample 102 (Comparative example) | A | None | Simultaneous multilayer coating | Present | 1 | Present | 2.07 |
| Sample 103 (This invention) | A | B | Simultaneous multilayer coating | Absent | 4 | Absent | 2.05 |
| Sample 104 (This invention) | A | B | Non-simultaneous multilayer coating | Absent | 3 | Absent | 2.04 |
| Sample 105 (Comparative example) | A | C | Simultaneous multilayer coating | Present | 2 | Present | 2.06 |
| Sample 106 (Comparative example) | A | D | Simultaneous multilayer coating | Present | 2 | Present | 2.00 |
| Sample 107 (This invention) | A | E | Simultaneous multilayer coating | Absent | 5 | Absent | 2.03 |
| Sample 108 (This invention) | A | F | Simultaneous multilayer coating | Absent | 5 | Absent | 2.01 |
| Sample 109 (Comparative example) | A | G | Simultaneous multilayer coating | Absent | 3 | Absent | 2.02 |
| Sample 110 (Comparative example) | A | H | Simultaneous multilayer coating | Absent | 3 | Absent | 2.08 |
| Sample 111 (Comparative example) | A | I | Simultaneous multilayer coating | Present | 3 | Present | 2.05 |
| Sample 112 (Comparative example) | A | J | Simultaneous multilayer coating | Present | 3 | Present | 2.04 |
| Sample 113 (This invention) | A | K | Simultaneous multilayer coating | Absent | 5 | Absent | 2.05 |
| Sample 114 (This invention) | A | L | Simultaneous multilayer coating | Absent | 5 | Absent | 2.06 |
| Sample 115 (This invention) | A | M | Simultaneous multilayer coating | Absent | 5 | Absent | 2.08 |
| Sample 116 (Comparative example) | A | N | Simultaneous multilayer coating | Absent | 3 | Absent | 2.07 |
| Sample 117 (Comparative example) | A | O | Simultaneous multilayer coating | Present | 2 | Present | 2.04 |
| Sample 118 (This invention) | A | P | Simultaneous multilayer coating | Absent | 3 | Absent | 2.06 |

TABLE 1-continued

| Sample | Heat-insulation-layer coating liquid Hollow polymer | Receptor-layer-coating liquid Water-soluble polymer | Coating method | Results: Generation of aggregation in receptor-layer-coating liquid | Image uniformity evaluation | Coating granular structure | Density |
|---|---|---|---|---|---|---|---|
| Sample 119 (This invention) | A | Q | Simultaneous multilayer coating | Absent | 3 | Absent | 2.05 |

A: MH 5055 manufactured by Nippon Zeon
B: POVAL PVA-102 (saponification degree 98-99%, polymerization degree 200) manufactured by Kuraray → This invention
C: UMR-10H (saponification degree 70-90%, polymerization degree 100) manufactured by Unitica Kasei → Comparative example
D: UMR-10HH (saponification degree 98% or more, polymerization degree 100) manufactured by Unitica Kasei → Comparative example
E: POVAL PVA-110 (saponification degree 98-99%, polymerization degree 1000) manufactured by Kuraray → This invention
F: GOUSENOL T-330 (saponification degree 95-98%, polymerization degree 1600) manufactured by Nippon Synthetic Chemical Industry → This invention
G: POVAL PVA-117 (saponification degree 98-99%, polymerization degree 1700) manufactured by Kuraray → Comparative example
H: POVAL PVA-135 (saponification degree 98-99%, polymerization degree 3500) manufactured by Kuraray → Comparative example
I: UMR-20M (saponification degree 50-70%, polymerization degree 200) manufactured by Unitica Kasei → Comparative example
J: GOUSENOL GL-03 (saponification degree 86.5-89%, polymerization degree 400) manufactured by Nippon Synthetic Chemical Industry → Comparative example
K: POVAL PVA-205 (saponification degree 87-89%, polymerization degree 500) manufactured by Kuraray → This invention
L: POVAL PVA-210 (saponification degree 87-89%, polymerization degree 1000) manufactured by Kuraray → This invention
M: POVAL PVA-217 (saponification degree 87-89%, polymerization degree 1700) manufactured by Kuraray → This invention
N: POVAL PVA-235 (saponification degree 87-89%, polymerization degree 3500) manufactured by Kuraray → Comparative example
O: Gelatin having an average molecular mass of 18,000 → Comparative example
P: Gelatin having an average molecular mass of 30,000 → This invention
Q: Gelatin having an average molecular mass of 100,000 → This invention It is understood that the composition of the present invention enables to obtain a high quality image with a high density and no image failure.

Having described our invention as related to the present embodiments, it is our intention that the invention not be limited by any of the details of the description, unless otherwise specified, but rather be construed broadly within its spirit and scope as set out in the accompanying claims.

What we claim is:

1. A heat-sensitive transfer image-receiving sheet comprising at least one heat insulation layer and at least one receptor layer on a support, wherein said heat insulation layer comprises at least one kind of hollow polymeric particles and said receptor layer comprises at least one latex polymer and at least one water-soluble polymer; wherein said water-soluble polymer is at least one of a gelatin and a polyvinyl alcohol in which the gelatin has an average molecular mass of 20,000 or more and the polyvinyl alcohol has a saponification degree of 95% or more and an average polymerization degree of from 200 to 1600 or has a saponification degree of less than 95% and an average polymerization degree of from 500 to 2000.

2. The method of producing a heat-sensitive transfer image-receiving sheet as claimed in claim 1, wherein said heat-sensitive transfer image-receiving sheet is produced according to a simultaneous multilayer-coating method using an aqueous coating solution.

* * * * *